US007677337B2

(12) United States Patent
Poeckl et al.

(10) Patent No.: US 7,677,337 B2
(45) Date of Patent: Mar. 16, 2010

(54) CONSTRUCTION DEVICE, IN PARTICULAR DRILLING DEVICE

(75) Inventors: Rudolf Poeckl, Schrobenhausen (DE); Alexander Preschl, Waihofen (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 278 days.

(21) Appl. No.: 11/806,572

(22) Filed: Jun. 1, 2007

(65) Prior Publication Data

US 2007/0278013 A1 Dec. 6, 2007

(30) Foreign Application Priority Data

Jun. 2, 2006 (EP) ..... 06011534

(51) Int. Cl.
*B66D 1/36* (2006.01)

(52) U.S. Cl. ..... 175/162; 175/202

(58) Field of Classification Search ..... 175/161, 175/162, 202, 203
See application file for complete search history.

(56) References Cited

U.S. PATENT DOCUMENTS 2,715,015 A * 8/1955 Thornburg ..... 173/10
4,353,424 A 10/1982 Schenck et al.
7,080,826 B2 7/2006 Poeckl et al.
2007/0175849 A1 8/2007 Yokoyama et al.

FOREIGN PATENT DOCUMENTS

| | | |
|---|---|---|
| DE | 202 03 662 | 7/2003 |
| DE | 103 43 079 | 5/2005 |
| JP | 2001-123784 | 5/2001 |
| JP | 2004-277165 | 10/2004 |
| WO | WO 2005/095255 | 10/2005 |

* cited by examiner

*Primary Examiner*—William P Neuder
(74) *Attorney, Agent, or Firm*—Jacobson Holman PLLC

(57) ABSTRACT

The invention relates to a construction device comprising a carrier vehicle with an undercarriage, a mast element arranged at the front side of the carrier vehicle and a winch drum, which is supported in a rotatable manner on the carrier vehicle. In accordance with the invention provision is made for the winch drum to be adjustable between a first position, in which it is arranged on the upper side of the carrier vehicle, and a second position, in which it is arranged in a rear portion of the carrier vehicle.

22 Claims, 5 Drawing Sheets

CONSTRUCTION DEVICE, IN PARTICULAR DRILLING DEVICE

The invention relates to a construction device, in particular a drilling device according to the preamble of claim 1. Such a construction device comprises a carrier vehicle having an undercarriage, a mast element arranged at the front side of the carrier vehicle and a winch drum which is supported in a rotatable manner on the carrier vehicle.

A construction device of such type is known for example from DE 103 43 079 B3. The known construction device has a carrier vehicle with a mast, on which a drilling device having a drill rod is supported in a longitudinally movable manner. The drill rod is carried by a rope, which can be actuated by means of a main winch arranged on the rooftop of the carrier vehicle.

The object of the invention is to provide a construction device of high stability whose transport dimensions are particularly small.

The object is solved in accordance with the invention by a construction device having the features of claim 1. Preferred embodiments are stated in the dependent claims.

The construction device according to the invention is characterized in that the winch drum is arranged in an adjustable manner on the carrier vehicle between a first position, in which it is arranged on the upper side of the carrier vehicle, and a second position, in which it is arranged in a rear portion of the carrier vehicle.

A fundamental idea of the invention can be seen in the fact that the winch drum is provided on the carrier vehicle not only in a rotatable manner but also in a movable manner together with its axis of rotation relative to the carrier vehicle. For the operation of the construction device the winch drum is suitably arranged in the first position on the upper side of the carrier vehicle. In this position it is located comparatively close to the front side of the carrier vehicle and hence to the mast element. As a result, a rope element located on the mast element can be taken up by the winch drum in a particularly easy way without requiring any complicated deflection devices. For the transport of the construction device provision is made according to the invention for the winch drum to be moved into the second position in the rear portion of the carrier vehicle. Compared to the arrangement on the upper side of the carrier vehicle the vertical clearance of the carrier vehicle determined by the winch drum is reduced in the rearward arrangement, whereby a particularly low transport height of the construction device is achieved.

In addition, by the translational movement, in accordance with the invention, of the winch drum relative to the carrier vehicle the centre of mass of the carrier vehicle can be influenced selectively and therefore an especially high stability can be achieved.

According to a preferred embodiment of the invention a construction device having a particularly simple design is provided in that the winch drum is supported in a winch frame, which is supported in a pivotable manner about a horizontal pivot axis. The horizontal pivot axis is suitably provided in a corner portion on the carrier vehicle. By preference, this corner portion is located on the transition between an approximately vertically extending rear part and an approximately horizontally extending roof part of the carrier vehicle. In arranging the pivot axis in the corner portion it is possible to pivot the winch drum together with the winch frame in a simple manner about the corner portion between the two positions.

To permit particularly easy transport of the construction device it is of advantage that the mast element is pivotably supported on the carrier vehicle between a substantially vertical operating position and a substantially horizontal transport position. In principle, provision can also be made for the mast element to be removed at least partly for the transport of the carrier vehicle.

According to the invention provision can be made for the mast element to be folded forwards towards the front side in the transport position. In such an embodiment the displacement of the centre of mass towards the front side resulting from the folding of the mast element into the transport position can be compensated at least partly in that, according to the invention, the winch drum is moved into the second, rearward position.

Alternatively, provision can be made for the mast element to be folded backwards over the carrier vehicle in the transport position. By moving the winch drum from the first rooftop position into the second position the pivot angle of the mast element can be increased in this embodiment and consequently the vertical clearance can be reduced.

Furthermore, in accordance with the invention it is advantageous for the pivot axis of the winch frame to extend at least approximately parallel to a pivot axis of the mast element.

In addition, it is useful that at least one linear drive, in particular a hydraulic cylinder is provided for adjustment of the winch drum. For best suitability the linear drive is arranged on the one hand on the winch frame and on the other hand preferably on the carrier vehicle.

It is especially advantageous for the linear drive to be arranged on an actuating mechanism for pivoting the mast element. In this case the linear drive can preferably serve both for the pivoting of the mast element and for the movement of the winch drum. For best suitability the mast element and the winch drum are adjusted simultaneously at least at times.

According to the invention a particularly reliable construction device is attained in that a detachable fixing device is provided for fixing the winch drum in the first position. For instance the fixing device can have lugs arranged on the winch frame and in a corresponding fashion on the carrier vehicle, in which case a bolt can be inserted through the lugs in order to fix the winch drum.

The work involved for the transport of the construction device according to the invention, whilst ensuring particularly good stability, can be reduced further in that at least one counterweight is detachably arranged on the rear of the carrier vehicle in a receiving portion for the winch drum in the second position. During operation of the construction device, when the winch drum is located in the first position outside the receiving portion, the counterweight can be installed in the receiving portion so as to increase the tilt resistance. For the transport of the carrier vehicle, especially when the mast element is in an inclined position or removed, the counterweight can be removed. Through this the receiving portion is cleared and the winch drum can be placed into the second position. In this position the winch drum assumes with its proper weight at least partly the function of the counterweight, and due to the absence of the counterweight the total weight of the construction device is reduced for easy transport.

In particular, the winch drum can be provided for winding up a rope element, e.g. a supporting rope, that extends at least in sections on the mast element. The winch drum may also serve to wind up e.g. other elongated materials, such as supply hoses or supply cables.

In the following the invention will be described in greater detail by way of preferred embodiments which are shown schematically in the Figures, wherein.

Figure 1:
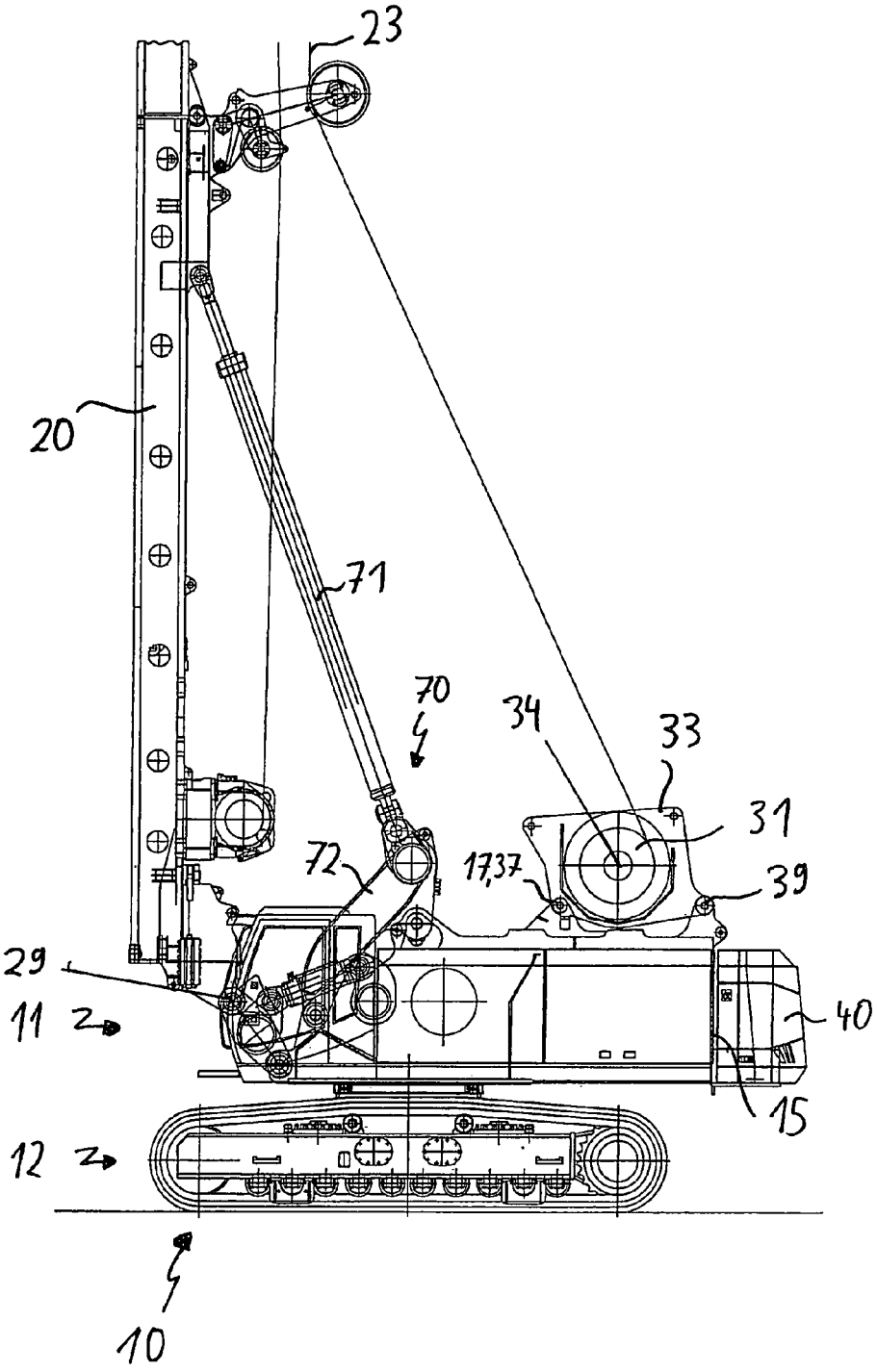
FIG. 1 shows a construction device according to the invention in an operating condition.
Figure 2:
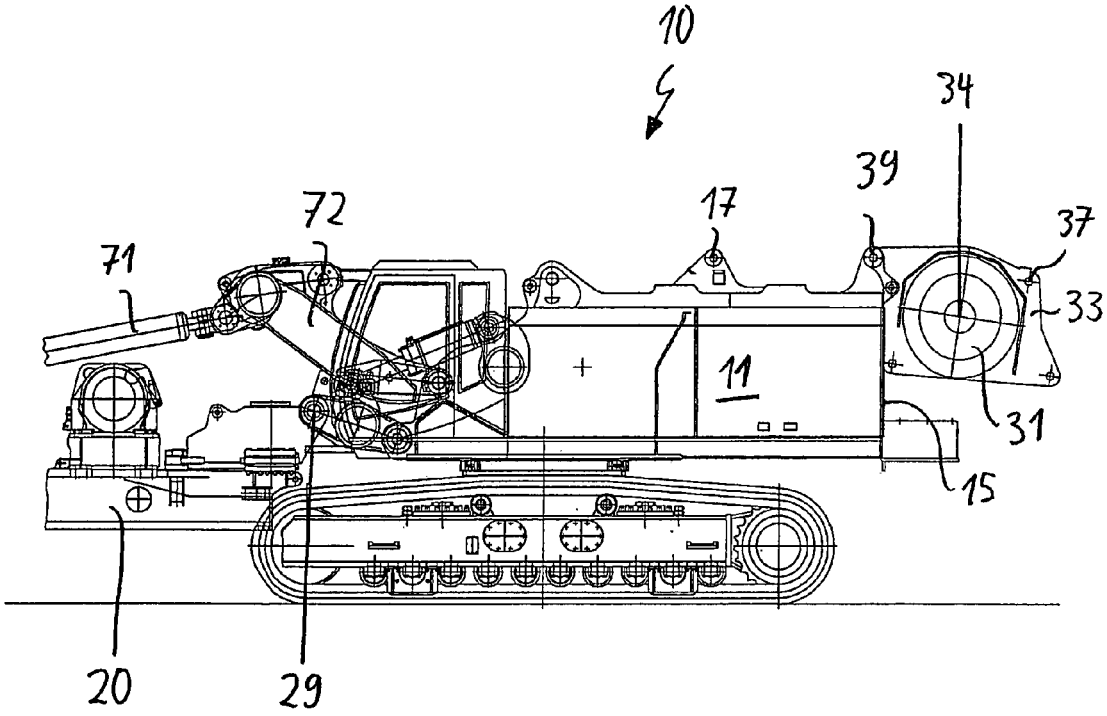
FIG. 2 shows the construction device of FIG. 1 in a transport condition.

A first embodiment of a construction device according to the invention is shown in FIGS. 1 and 2. The construction device has a carrier vehicle 10 with an undercarriage 12 and an upper carriage 11, the upper carriage 11 being supported in a rotatable manner on the undercarriage 12 about an approximately vertically extending axis. On the front side of the upper carriage 11 a mast element 20 is arranged, on which e.g. a drilling device can be supported in a longitudinally movable manner. A rope 23 extends in sections longitudinally of the mast element 20, on which the drilling device can be suspended for example. For winding up and unwinding the rope 23 a winch with a winch drum 31 is provided on the upper carriage 11.

The mast element 20 is provided in a pivotable manner about an approximately horizontally extending pivot axis 29 on the carrier vehicle 10. In the condition illustrated in FIG. 1 the mast element 20 is located in an operating position, in which it extends at least approximately in the vertical direction. In the condition depicted in FIG. 2 the mast element 20 is pivoted about the pivot axis 29 away from the carrier vehicle 10 into an approximately horizontal transport position, in which the mast element 20 protrudes forwards from the front side of the upper carriage 11.

For the active pivoting of the mast element 20 an actuating mechanism 70 is provided. The said mechanism has, amongst others, a neck cylinder 71 that is hinged on the one hand to the mast element 20 and on the other hand to a boom 72, which is hinged for its part to the upper carriage 11.

The winch drum 31 is supported in a winch frame 33 by being rotatable about an axis of rotation 34. The winch frame 33 has two bearing plates arranged on both front faces of the winch drum 31. Through a roller bearing or a friction bearing provided on the winch frame 33 the winch drum 31 is fixed in a pivotable manner together with the winch frame 33 on the upper carriage 11 about an approximately horizontally extending pivot axis 39. This pivot axis 39 extends approximately parallel to the axis of rotation 34 of the winch drum 31 in the winch frame 33.

In the operating condition shown in FIG. 1 the winch drum 31 is located with the winch frame 33 in a first position above the carrier vehicle 10. In the transport condition shown in FIG. 2 the winch drum 31 is pivoted with the winch frame 33 about the pivot axis 39 behind the carrier vehicle 10 into its rear part. To make this movement possible the pivot axis 39 is arranged in the transitional region between an approximately vertically extending rear part 15 and the upper side of the upper carriage 11 of the carrier vehicle 10. The pivoting of the winch drum 31 from the first operating position into the second transport position is accompanied by a lowering of the axis of rotation 34 of the winch drum 31 and a reduction of the vertical clearance of the carrier vehicle 10 determined by the winch drum 31 and the winch frame 33.

In the operating condition depicted in FIG. 1 a counterweight 40 is arranged on the rear part 15 of the carrier vehicle 10. This counterweight 40 has been removed in the transport condition depicted in FIG. 2. In doing so a receiving portion is cleared, into which the winch drum 31 is pivoted together with the winch frame 33.

To fix the winch frame 33 with the winch drum 31 in the first position at least one lug 17 is provided at the upper side of the carrier vehicle 10. The lug 17 is arranged in such a manner that it is aligned with a lug 37 provided on the winch frame 33 when the winch frame 33 with the winch drum 31 are located in the first position. To secure the winch frame 33 a safety bolt can then be inserted through the two corresponding lugs 17, 37.

Figure 3:
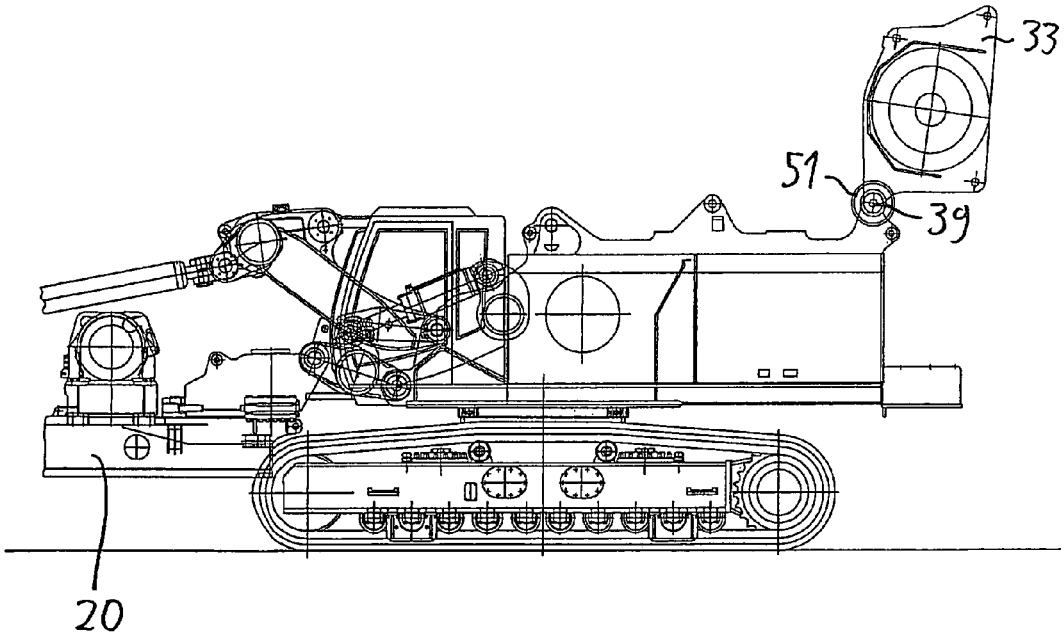
FIGS. 3 to 5 show modifications of the construction device of FIGS. 1 and 2 with driving devices designed in varying ways for moving the winch drum between the two positions.
Figure 4:
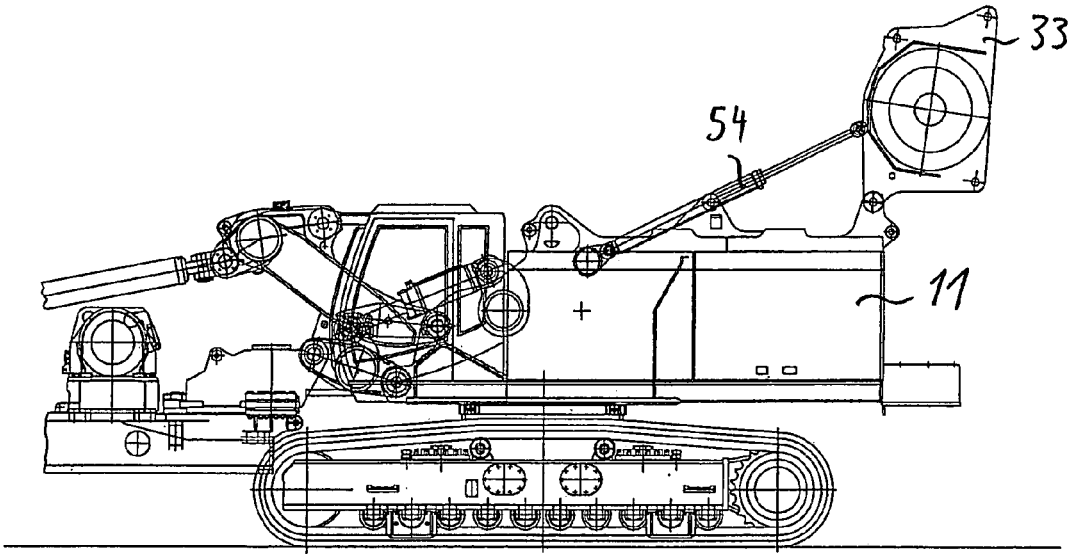
Figure 5:
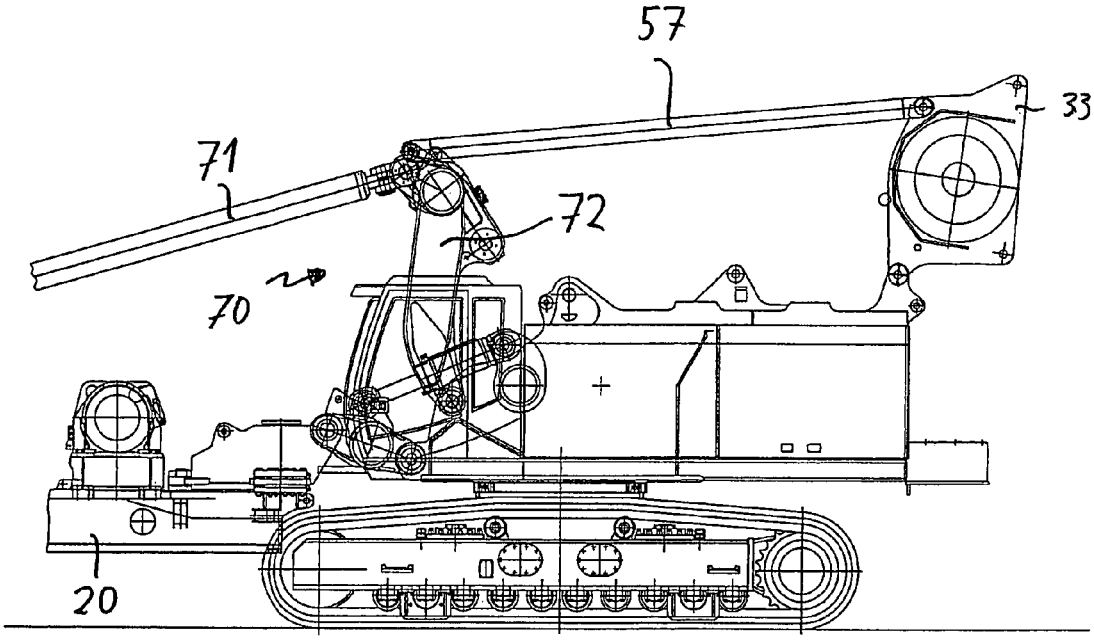

FIGS. 3 to 5 show various embodiments of drives that can be provided for pivoting the winch frame 33 jointly with the winch drum 31.

According to the embodiment of FIG. 3 a rotary drive 51 is provided in the area of the pivot axis 39 of the winch frame 33.

According to the embodiment of FIG. 4 a hydraulic cylinder 54 is provided, which is hinged on the one hand to the winch frame 33 and on the other hand to the upper carriage 11.

According to the embodiment of FIG. 5 an actuating rod 57 is provided, which is preferably of rigid design and is hinged on the one hand to the winch frame 33 and connected on the other hand to the actuating mechanism 70 provided for pivoting the mast element 20. By such an arrangement it is rendered possible that the driving means used for pivoting the mast element 20 are also employed for pivoting the winch frame 33 with the winch drum 31, in particular in a simultaneous manner. In the present embodiment the actuating rod 57 is provided on the boom 72 for the neck cylinder 71.

Basically, instead of the actuating rod 57 the neck cylinder 71 can also be connected to the winch frame 33 and used for pivoting the winch drum 31.

The invention claimed is:

1. A construction device comprising a carrier vehicle having an undercarriage, a mast element arranged at the front side of the carrier vehicle, and a winch drum which is supported in a rotatable manner on the carrier vehicle, wherein the winch drum is supported in a winch frame, which is supported in a pivotable manner about a horizontal pivot axis, the horizontal pivot axis being provided in a corner portion on the carrier vehicle, the winch drum being arranged in an adjustable manner on the carrier vehicle between a first position, in which it is arranged on the upper side of the carrier vehicle, and a second position, in which it is arranged in a rear portion of the carrier vehicle.

2. The construction device according to claim 1, wherein the mast element is pivotably supported on the carrier vehicle between a substantially vertical operating position and a substantially horizontal transport position.

3. The construction device according to claim 2, wherein in the transport position the mast element is folded forwards towards the front side or backwards over the carrier vehicle.

4. The construction device according to claim 2, wherein the mast element has a pivot axis, the horizontal pivot axis of the winch frame extending at least approximately parallel to the pivot axis of the mast element.

5. The construction device according to claim 1, wherein for adjustment of the winch drum at least one linear drive is provided.

6. The construction device according to claim 5, wherein the linear drive is arranged on an actuating mechanism for pivoting the mast element.

7. The construction device according to claim 1, wherein a detachable fixing device is provided for fixing the winch drum in the first position.

8. The construction device according to claim 1, wherein at least one counterweight is detachably arranged on the rear of the carrier vehicle in a receiving portion for the winch drum in the second position.

9. The construction device according to claim 1, wherein the winch drum is provided for winding up a rope element extending on the mast element.

10. The construction device according to claim 1, wherein the construction device is a drilling device.

11. A construction device comprising:

a carrier vehicle having an undercarriage, a mast element arranged at the front side of the carrier vehicle, and a winch drum which is supported in a rotatable manner on the carrier vehicle, wherein the winch drum is arranged in an adjustable manner on the carrier vehicle between a first position, in which it is arranged on the upper side of the carrier vehicle, and a second position, in which it is arranged in a rear portion of the carrier vehicle and wherein for adjustment of the winch drum at least one linear drive is provided the linear drive being arranged on an actuating mechanism for pivoting the mast element.

12. The construction device according to claim 11, wherein the mast element is pivotably supported on the carrier vehicle between a substantially vertical operating position and a substantially horizontal transport position.

13. The construction device according to claim 12, further comprising a winch frame for supporting the winch drum, and wherein the winch frame has a pivot axis and the mast element has a pivot axis, the pivot axis of the winch frame extending at least approximately parallel to the pivot axis of the mast element.

14. The construction device according to claim 11, wherein the construction device is a drilling device.

15. A construction device comprising:

a carrier vehicle having an undercarriage, a mast element arranged at the front side of the carrier vehicle, and a winch drum which is supported in a rotatable manner on the carrier vehicle, a detachable fixing device for fixing the winch drum in a first position, wherein the winch drum is arranged in an adjustable manner on the carrier vehicle between the first position, in which it is arranged on the upper side of the carrier vehicle, and a second position, in which it is arranged in a rear portion of the carrier vehicle.

16. The construction device according to claim 15, wherein the mast element is pivotably supported on the carrier vehicle between a substantially vertical operating position and a substantially horizontal transport position.

17. The construction device according to claim 16, further comprising a winch frame for supporting the winch drum, and wherein the winch frame has a pivot axis and the mast element has a pivot axis, the pivot axis of the winch frame extending at least approximately parallel to the pivot axis of the mast element.

18. The construction device according to claim 15, wherein the construction device is a drilling device.

19. A construction device comprising:

a carrier vehicle having an undercarriage, a mast element arranged at the front side of the carrier vehicle, and a winch drum which is supported in a rotatable manner on the carrier vehicle, wherein the winch drum is arranged in an adjustable manner on the carrier vehicle between a first position, in which it is arranged on the upper side of the carrier vehicle, and a second position, in which it is arranged in a rear portion of the carrier vehicle, at least one counterweight being detachably arranged on the rear of the carrier vehicle in a receiving portion for the winch drum in the second position.

20. The construction device according to claim 19, wherein the mast element is pivotably supported on the carrier vehicle between a substantially vertical operating position and a substantially horizontal transport position.

21. The construction device according to claim 20, further comprising a winch frame for supporting the winch drum, and wherein the winch frame has a pivot axis and the mast element has a pivot axis, the pivot axis of the winch frame extending at least approximately parallel to the pivot axis of the mast element.

22. The construction device according to claim 19, wherein the construction device is a drilling device.

* * * * *